US008317454B1

(12) United States Patent
Parker

(10) Patent No.: US 8,317,454 B1
(45) Date of Patent: Nov. 27, 2012

(54) STONE HANDLING FRAME

(76) Inventor: Walter B. Parker, Halifax, VA (US)

( * ) Notice: Subject to any disclaimer, the term of this patent is extended or adjusted under 35 U.S.C. 154(b) by 334 days.

(21) Appl. No.: 12/592,018

(22) Filed: Nov. 18, 2009

(51) Int. Cl.
*F25C 5/00* (2006.01)
*F25C 5/16* (2006.01)

(52) U.S. Cl. ..... 414/770

(58) Field of Classification Search ..... 414/10–12, 414/754, 758, 768, 769, 770, 775, 778, 779, 414/780, 784, 919; 52/122.1, 124.2
See application file for complete search history.

(56) References Cited

U.S. PATENT DOCUMENTS

| | | | | |
|---|---|---|---|---|
| 2,168,205 | A * | 8/1939 | Harten et al. | 294/67.3 |
| 2,423,251 | A * | 7/1947 | Muller | 414/770 |
| 2,557,357 | A * | 6/1951 | Maddox | 414/754 |
| 2,985,261 | A * | 5/1961 | Kubesh | 52/120 |
| 3,136,429 | A * | 6/1964 | Kleinschmidt | 414/809 |
| 4,027,803 | A * | 6/1977 | Kawasaki et al. | 414/11 |
| 4,590,719 | A * | 5/1986 | McKibbin | 52/116 |
| 4,662,146 | A * | 5/1987 | Parry | 52/745.14 |
| 5,061,528 | A * | 10/1991 | Ruehl | 427/430.1 |
| 6,334,287 | B1 * | 1/2002 | Fick | 52/745.11 |
| 6,869,261 | B2 * | 3/2005 | Burke | 414/11 |
| 2005/0247012 | A1 * | 11/2005 | Williams | 52/742.14 |
| 2009/0290968 | A1 * | 11/2009 | Tamura | 414/758 |

FOREIGN PATENT DOCUMENTS

WO WO 2008010475 A1 * 1/2008

* cited by examiner

*Primary Examiner* — Gregory Adams

(57) ABSTRACT

A frame for receiving, storing and handling a sheet of stone or slab. The stone is stored or placed in the vertical position and then tilted to the horizontal position for fabrication or other purposes. Any embodiment of the frame allows the fabricator to fabricate the stone with out the need for a crane or bridge saw.

18 Claims, 3 Drawing Sheets

STONE HANDLING FRAME

BACKGROUND

Polished stone such as the granite that is used on some kitchen counter tops originates at quarries at different locations around the world. The stone is cut from the ground in blocks that are shipped to factories located in other countries. The factory will saw the blocks into sheets that are known as slabs. Most slabs are about 3 center meters, 1¼ inch, thick, 2.13 meters, 7 feet, high, and 2.74 meters, 9 feet, to 3.04 meters, 10 feet, long depending on the size of the block. After sawing the slab is polished on one side to give the glass like shine. The slabs that weigh about 2207 kilograms, 1000 pounds, each are then shipped to distribution centers within the country that the block was shipped to. The slabs have to be shipped and stored in a vertical position to prevent them from breaking. The distributor will ship individual slabs as needed to fabrication shops with in driving distance of the distributor.

When the slabs are received by the fabrication shop the edges are unfinished. The shop has to saw the slab to sizes that are needed and finish or polish the edges that show. The truck that delivers the slab to the shop has a crane that sets the slab into a storage frame in the vertical position. The shop has a crane that sets the slab on to a powered table that is sometimes known as a concrete table. The table top is in the approximately vertical position to receive the slab. The table top with the slab is rotated to the horizontal position and rolled a few feet under the bridge saw to make the first cut, The powered table is moved again for the next and each additional cut. After cutting the slab into needed pieces now weighing 441 kilograms, 200 pounds, to 662 kilograms, 300 pounds, the pieces are moved to another supporting device to finish and polish the visible edges. Holes for sinks are usually cut out at the job site.

The pieces are then installed at the job site by the installer. The installer may be a local carpenter or could be a person from the fabrication shop.

SUMMARY

Aspects of the present disclosure relate to apparatuses, systems and methods for handling one or more sheets of stone. Some aspects relate to a frame for handling a sheet of stone. The frame includes a pivotal member that can pivot from a substantially vertical position to a substantially horizontal position. The pivotal member includes a surface and is configured to receive the sheet of stone so that the sheet of stone can be rotated from a substantially vertical position to a substantially horizontal position. The frame further includes a winch member connected to a fixed object. The winch member is capable of being connected to the pivotal member to lift or lower one end of the pivotal member and therefore enabling pivoting of the sheet of stone from the substantially vertical position to the substantially horizontal position.

Other aspects of the present disclosure relate a method for handling sheets of stone. The method includes placing one or more sheets of stone in a substantially vertical position onto a pivotal member, where the pivotal member comprising a first end, a center portion and a second end, wherein the pivotal member is capable of pivoting from a substantially vertical position to a substantially horizontal position. The method further includes pivoting the pivotal member from the substantially vertical position to the substantially horizontal position using a lowering member, the lowering member being connected to the pivotal member and configured to lower the second end of the pivotal member, the pivoting the pivotal surface occurs about an axis that is aligned along the first end. Therefore, the sheets of stone are placed in the substantially vertical position and pivoted to the substantially horizontal position.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, embodiments of the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Figure 1:
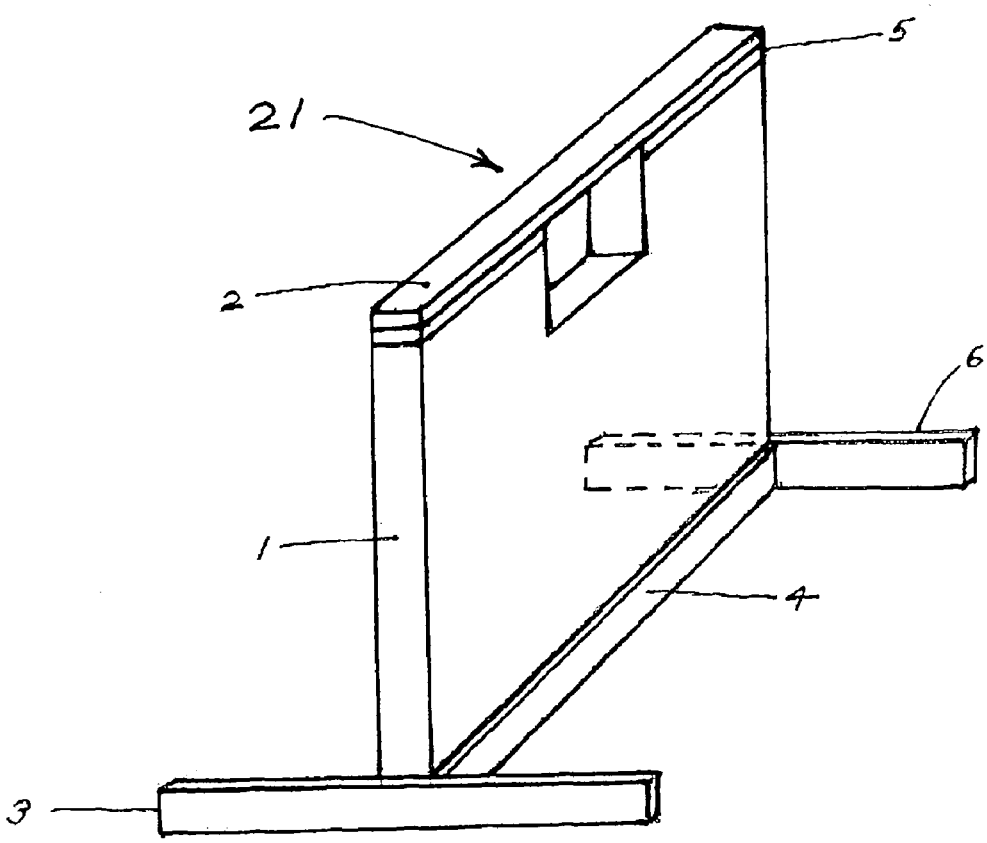
FIG. 1 illustrates a three-dimensional view of a system for handling at least one sheet of stone according to some aspects.
Figure 2:
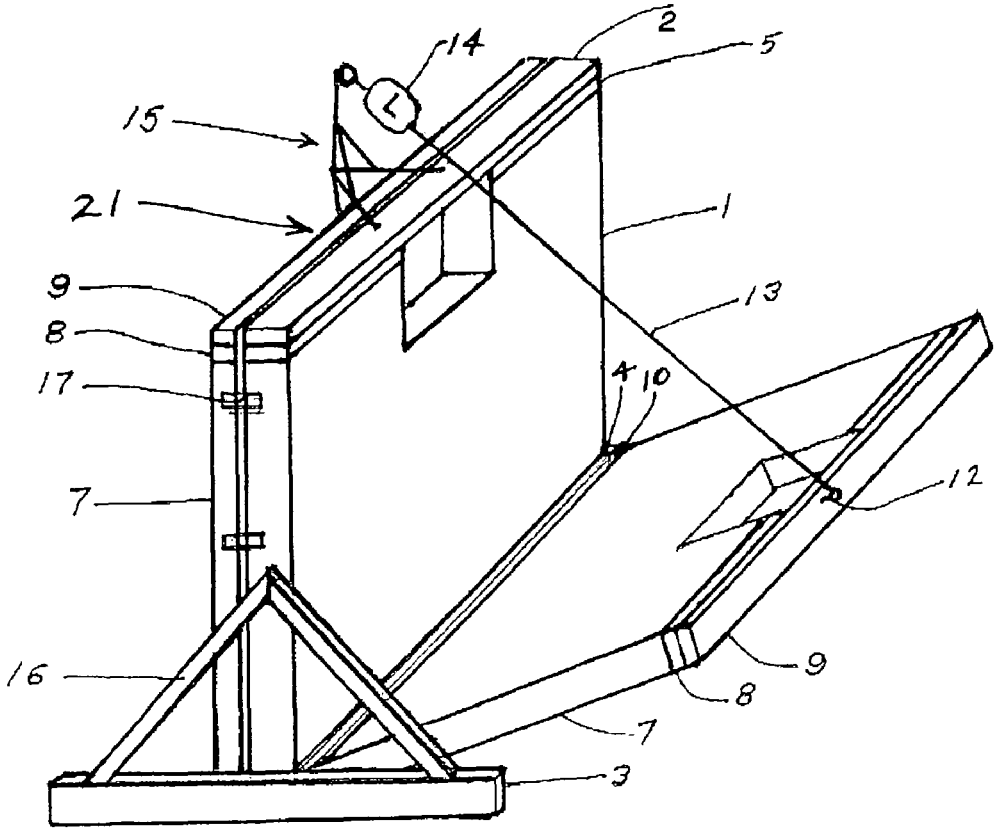
FIG. 2 illustrates a three-dimensional view of another system for handling at least one sheet of stone according to some aspects.

An exemplary stone handling frame is illustrated in FIGS. 1 and 2. Elements of embodiments described herein are referred to as follows: (1) Fixed vertical surface, part 1; (2) Bottom support, part 3; (3) Pivotal surface, part 7; (4) Top brace for the fixed vertical surface, part 2; (4-a). Top brace for the pivotal surface, part 9; (5) Lifting and lowering means, part 14; (6) Lifting and lowering means support, assembly 15; (7) Tilting braces, FIG. 3; (8) Cross braces, part 17; (9) Pivotal surface support, part 4; and (10) Pivotal surface slab support, part 10.

In some embodiments the fixed vertical surface 1 may remain vertical.

In some embodiments the bottom support 3 may be a horizontal member that holds the fixed vertical surface in the vertical position if the fixed vertical surface is not mounted to the ground or floor. FIG. 1.

Figure 2A:
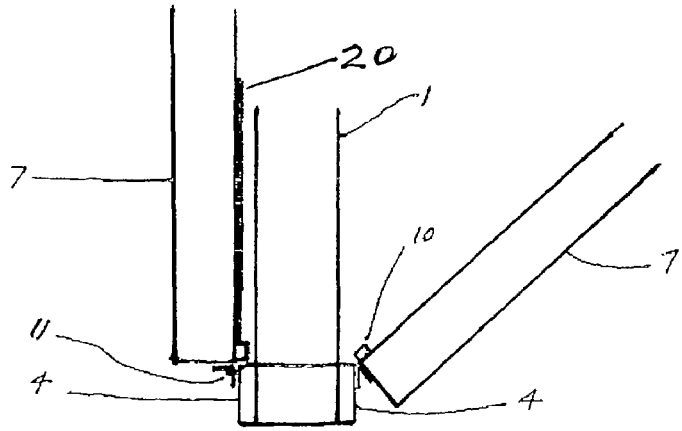
FIG. 2A illustrates a side view of a portion of the system of FIG. 2 according to some aspects.

In some embodiments, the pivotal surface 7 may have a means of rotation at the bottom to move the slab from the vertical position to the horizontal plane. FIG. 2A.

In some embodiments, the top brace 2 for the fixed vertical surface may be a horizontal member that attaches temporarily to the top of the fixed vertical surface after the slab is set in the frame. This member is what the lifting means support attaches to. FIG. 2.

In some embodiments, the top brace 9 for the pivotal surface may be a horizontal member that attaches temporarily to the top of the pivotal surface after the slab is set in the frame. This member is what the lifting and lowering means cable attaches to when the slab is ready to tilt to the horizontal plane. FIG. 2.

In some embodiments, the lifting and lowering means 14 is any means of lifting or lowering and is used to tilt the slab to the horizontal plane. It can be an electric or hand operated winch or it could be pulleys and rope, part 14.

In some embodiments, the lifting and lowering means support 15 is a brace that connects the lifting and lowering means to the fixed vertical surface top brace and to the fixed or pivotal surface so that three points of support attach the support assembly. It is used if the lifting and lowering means is not attached to some fixed object such as a post or wall. FIG. 2.

Figure 3:
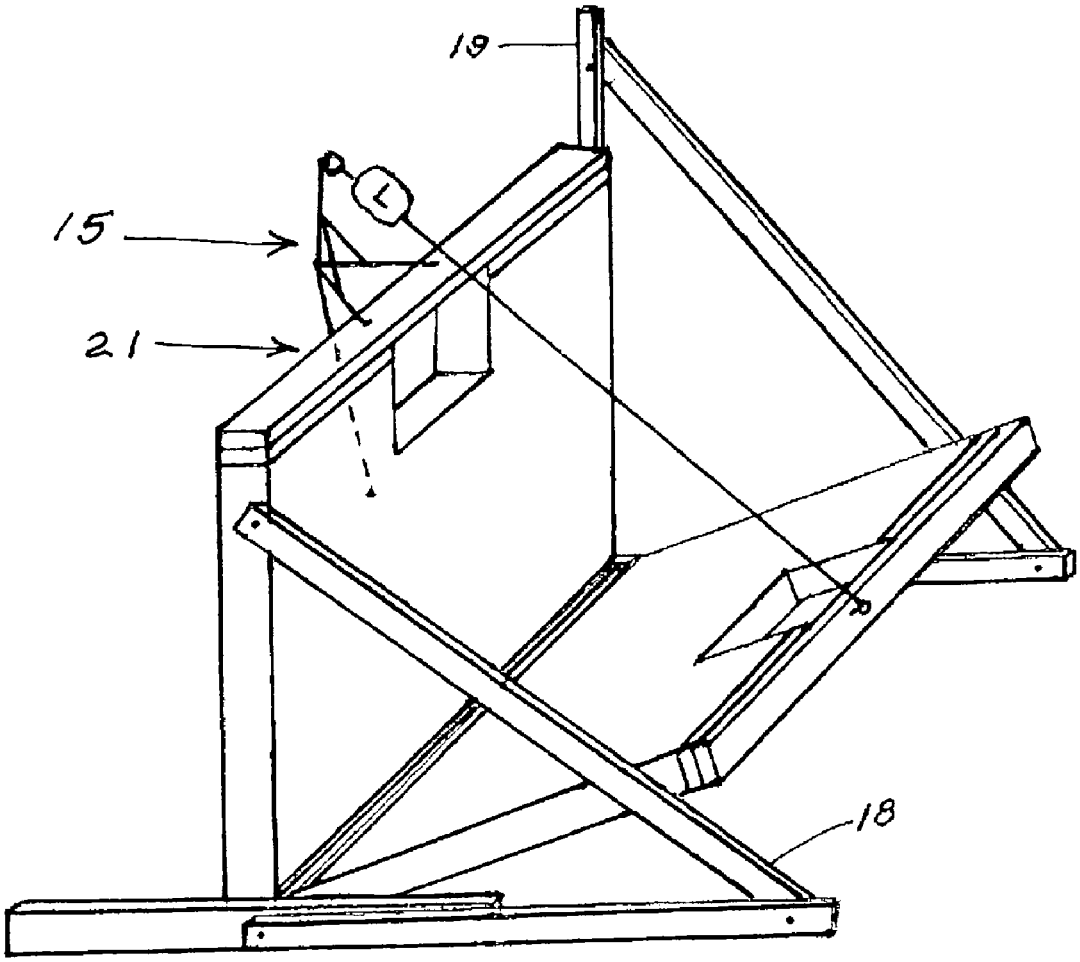
FIG. 3 illustrates a three-dimensional view of yet another system for handling at least one sheet of stone according to some aspects.

In some embodiments, the tilting braces are the temporary braces that hold the fixed vertical surface in the vertical position while the slab (and pivotal surface) are tilted or rotated to the horizontal plane. FIG. 3.

In some embodiments, the cross braces 17 are the short temporary braces that hold either or both pivotal surfaces in the vertical position while the slab is stored on the frame. FIG. 2.

In some embodiments, the pivotal surface support 4 is a horizontal member that is attached to the bottom of the fixed vertical surface for the purpose of attaching the bottom of the pivotal surface to the fixed vertical surface using hinges or any means of rotation. FIG. 2A.

In some embodiments, the pivotal surface slab support 10 is a strip of material at the bottom of the pivotal surface that keeps the slab from sliding as it tilts to the horizontal plane. Part 10.

Figure 1A:
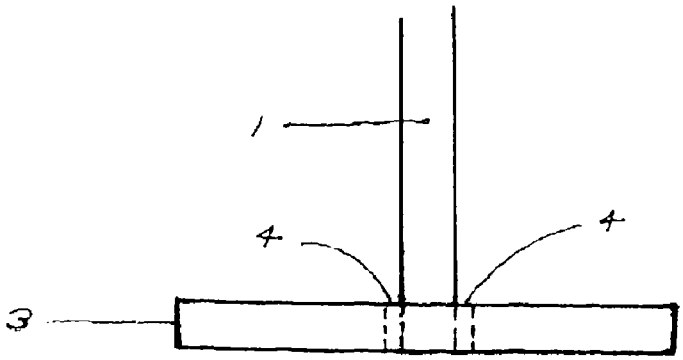
FIG. 1A illustrates a side view of the system of FIG. 1 according to some aspects.

The stone handling frame comprises a fixed vertical surface with the height higher than the anticipated height of the slabs. If the slabs are expected to be about 2.13 meters, 7 feet by 3.05 meters, 10 feet, then the fixed vertical surface may be over 2.13 meters, 7 feet high measured from the top of the bottom support (FIG. 1A). The length of the frame can be less than the expected length of the slabs. If the slabs are expected to be about 2.13 meters, 7 feet by 3.05 meters, 10 feet, the frame could be about 2.58 meters, 8½ feet long with about 0.46 meters, 1½ feet of slab extending past the rear.

The fixed vertical surface is attached to two bottom supports of sufficient length to maintain the fixed vertical surface in the vertical position (FIG. 1). The bottom supports are at each end of the fixed vertical surface, FIG. 1. The fixed vertical surface can also be permanently mounted to the ground or floor.

A pivotal surface is located on each side of the fixed vertical surface FIG. 2A. Hinges or any means of pivoting are located at the bottom and connecting the pivotal surface to the fixed vertical surface so that the pivotal surface can tilt or pivot from the vertical position to the horizontal position (FIG. 2A).

A lifting and lowering device, such as a winch, is mounted at the top of the fixed vertical surface and attached to the top of the pivotal surface, FIG. 2 so that the pivotal surface and the stone slab can be pivoted or tilted from the vertical position to the horizontal position for fabricating. The lifting and lowering device 14 is designated by the oval shape with the L. The lifting and lowering device can also be attached to any fixed object such as a post or wall.

When the lifting and lowering device is attached to the top of the fixed vertical surface, a removable support 15 positions the lifting device on the side of the fixed vertical surface that is opposite from the pivotal surface that will be pivoted to the horizontal position FIG. 2. The lifting and lowering device can be an electrical or mechanical winch that can safely lift or lower 2207 kilograms, 1000 lb. or the anticipated weight of the slab. The support for the lifting and lowering device can mount on either side of the fixed vertical surface so that either pivotal surface can be pivoted to the horizontal position, FIG. 2.

The fixed vertical surface and both pivotal surfaces have an opening in the center to allow the lifting hook on the delivery truck crane to set the slab onto the Stone Handling Frame, FIG. 2. Most lifting hooks are the same size, but measurements may be needed to be made on the crane lifting hook.

The fixed vertical surface has to be wide enough to allow the crane lifting hook to set a second slab onto the Stone Handling Frame after the first slab has been set. The narrow side of the crane lifting hook clears the first slab when the second slab is set. The finished surface on both slabs face toward the fixed vertical surface to allow cut lines to be drawn on the surface of each slab after it is pivoted to the horizontal position, FIG. 2.

If the fixed vertical surface is not permanently mounted to the floor or ground, bottom supports are provided at each end and are long enough to keep the Stone Handling Frame from turning over while a slab is stored on the frame FIG. 1.

For high wind conditions anchors and straps can be used. The front end of the Stone Handling Frame is the end that is seen of the end view drawings. The front end is the left end of the right side view. The bottom support at the front end may have permanent 45 degree braces to stabilize the vertical support surface, FIG. 2. For storage of the slabs, the rear end may include temporary 45 degree braces attached to the pivotal surface if the slab extends beyond the end of the frame. If the frame is used for storage of the slabs top cross braces are temporarily attached from the top of the fixed vertical surface to the top of the pivotal surface. Additional cross braces are attached at the front end from the fixed vertical surface to both pivotal surfaces, FIG. 2, for storage.

Operation

When the stored slabs are ready to be tilted or pivoted to the horizontal position for fabrication, the top cross braces are removed but the end cross braces remain in place to hold the pivotal surfaces and slabs in the vertical position. A fixed vertical surface top brace, part 2, is attached to the top of the fixed vertical surface. This is pre drilled for mounting the lifting and lowering device support, assembly 15.

A pivotal surface top brace, part 9, is attached to the top of the pivotal surface. This brace has a hook or means of attaching the cable from the lifting and lowering device (winch).

The support, assembly 15, for the lifting and lowering device, part 14, is attached to the fixed vertical surface top brace, part 2. This support can be a metal frame that the lifting and lowering device attaches to. The lifting and lowering device is attached to the support for the lifting and lowering device. It may attach high enough that the cable will not wear on the fixed vertical surface top brace. The cable from the lifting and lowering device is attached to the hook, part 12, on the pivotal surface top brace. The support, assembly 15, also attaches to the pivotal surface, part 7, or the fixed surface, part 1, to form a three point support for the lifting and lowering device. A safety rope is attached from the fixed vertical surface top brace to the pivotal surface top brace.

The tilting braces, part 18, FIG. 3, are attached on the side that will be tilted or pivoted to the horizontal position. Notice that the rear tilting brace is mounted higher if the slab extends beyond the end of the frame. One may check to see that the lifting and lowering device is engaged and holding the pivotal surface in the vertical position. One may also check to see that the safety rope is attached to both top braces. The front cross braces are removed. The rear 45 degree brace are also removed if attached to the pivotal surface. The pivotal surface and slab are tilted or pivoted to the horizontal position, adjusting the safety rope as needed. Blocks are placed on the ground or floor to hold the pivotal surface in the horizontal position. After lowering the pivotal surface onto the blocks, the lifting and lowering device cable are disconnected from the pivotal surface top brace and the cable is retracted. The pivotal surface top brace are removed. The slab is then ready to saw into the needed sizes.

DETAIL DESCRIPTION OF THE PARTS

The bottom of each pivotal surface has a means of rotation that will allow the pivotal surface to pivot to the horizontal position, FIG. 2A. These hinges or means of rotation are able to support 3000 kilograms, 1000 pounds or the anticipated weight of the slab. To do this, approximately ten 0.1 meter, 4 inch steel hinges may be employed.

A pivotal surface slab support member, part 10, may be needed to support the bottom edge of the slab, FIG. 2A. One inch by one inch by the length of the pivotal surface provides enough support for a 3 cm, 1¼ inch slab.

A supporting member, part 4, is attached to the lower edge of the fixed vertical surface in order to attach the means of rotation (hinges) on the pivotal surface to the fixed vertical surface. This member has a height that is equal to the thickness of the pivotal surface. It has a thickness that is 0.6 cm, ¼ inch more than the thickness of the anticipated slab. For most 3 cm, 1¼ inch, slabs a 1½ inch thickness will work.

When the pivotal surface pivots it clears the two bottom horizontal supports, part 3, of the fixed vertical surface. It also clears any fasteners for these supports. The pivotal surfaces also clear the 45 degree braces at the front of the fixed vertical surface, FIG. 2.

The tilting braces are temporary braces, part 18, that are attached on the side that is being pivoted to the horizontal position, FIG. 3. These braces are removed as soon as the pivotal surface with the slab is pivoted to the horizontal position and supported by the floor or ground with blocks. These braces are attached to the top and bottom of the fixed vertical surface and they have to be longer than the height of the slab, FIG. 3. The two tilting braces and the end of the fixed vertical surface form a fixed triangle which prevents the frame from turning over during the pivoting process. The top of the rear tilting brace may have to attach to an extension, part 19, that is attached to the rear of the fixed vertical surface, if the slab is longer than the fixed vertical surface, FIG. 3. This is done to allow the slab to clear the rear upper tilting brace.

Some type of safety rope or cable from the top of the fixed vertical surface to the top of the pivotal surface is recommended. This safety rope has to have a working load of 1000 pounds or the anticipated weight of the slab.

Transfer of the Slab from the Truck to the Frame

Before the delivery truck arrives, the pivotal surface may be in the vertical position with the top brace, part 9, removed. The fixed vertical surface has the top brace, part 2, removed. The front of the frame has cross braces, part 17, from the fixed vertical surface to the pivotal surface. These cross braces are attached only on the front of the two surfaces so that the top is open. A rear temporary 45 degree brace is installed from the bottom support to the rear of the pivotal surface if the slab is longer than the length of the frame. If the slab is shorter than the length of the frame then cross braces can be used at the rear.

One then may check to see that there is at least 1½ inches of clearance, or more than the anticipated thickness of the slab, between the two surfaces.

When the delivery truck crane sets the slab into the frame the finished or polished side of the slab faces the fixed vertical surface. After setting the first slab a cushion can be placed over the top mid section to prevent scratching. When setting the second slab, the polished side has to face the fixed vertical surface. The narrow side of the crane hook may face the first slab when the second slab is set.

After the two slabs are set they are ready to store for future work or ready to tilt for fabrication. If they are stored, the cross braces on the top are attached and if necessary wind straps can be added. The cross braces are temporary short braces that hold the pivotal surface in the vertical position for storage.

When the stored slabs are ready for fabrication, follow the operation instructions for tilting the stone to the horizontal position.

After the fabrication is completed and the stone removed, the pivotal surface can be raised to the vertical position and braced with cross braces. The lifting and lowering device may not be needed to raise the empty pivotal surface.

Wood is one embodiment that will work for the frame because it will allow the saw blade to pass through the thickness of the slab. If too many cuts are made, wood runners can be attached to the pivotal surface. If metal or nonmetal is used to make the frame wood strips may have to be added to the pivotal surface to allow the blade on the stone saw to pass through the slab.

Figure 4:
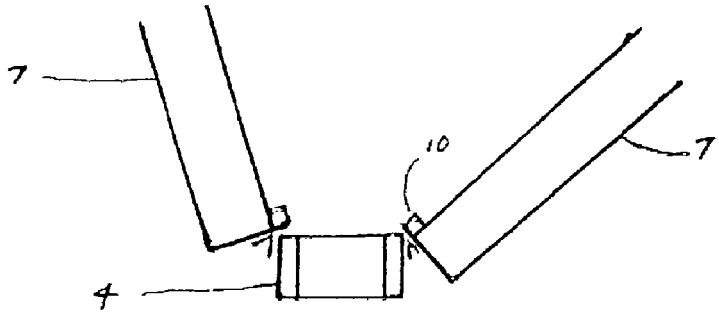
FIG. 4 illustrates a side view of a portion of the system of FIG. 3 according to some aspects.

Another embodiment can be the frame as described above with out the fixed vertical surface. The lifting or lowering device can be attached to any fixed object such as a wall, post, or rafter. The pivotal surfaces can be locked or braced at an angle which is substantially vertical but has enough angle to prevent the slab from falling after it is set onto the pivotal surface. Note that some types of slabs can break if supported by the top and leaned to about 60 degrees from the horizontal position. All slabs can be stored as vertical as possible with out the chance of falling. The slabs are then pivoted to the horizontal position when ready for fabrication. When pivoting, the pivotal surface is firmly attached to the ground or floor and tilting braces used if the lifting or lowering device is attached to some fixed object other than the frame which holds the slabs. The advantage of this embodiment is that it may be a little faster setting the slabs onto the frame. The disadvantage is that some fixed object is available to attach the lifting or lowering device to. Another disadvantage is that the frame is secured to the ground or floor. FIG. 4.

The diagrams in the figures illustrate the architecture, functionality, and operation of possible implementations of systems and methods according to various embodiments of the present invention. It should also be noted that, in some alternative implementations, the steps described herein may occur out of the order noted in the Figures.

Embodiments of the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A sheet pivoting apparatus for pivoting a stone sheet from a vertical orientation to a horizontal orientation whereby the sheet is supported on its face thereby preventing stress which may cause the sheet to break, the apparatus comprising:

a pair of braces supported by a ground surface for free-standing support of device in a workspace environment, wherein each said brace includes a horizontal member (3) and a pair of upwardly angled members (16);

a horizontal base (4) interconnecting said base members;

a fixed vertical object 1 having a substantially rectangular shape and including an upper horizontal side, lower horizontal side and a pair of vertical sides, the sides defining a substantially rectangular shape horizontally oriented, wherein the horizontal sides are parallel with a ground surface and interconnecting the braces at a bottom portion thereof;

wherein the upper horizontal side of the fixed vertical object includes a cut-out portion centrally located and sized to allow a crane hook for placement therein when a sheet is delivered to the apparatus;

wherein the upwardly angled members are affixed to and support the vertical object at a respective end, wherein the fixed vertical object is positionally fixed on top of the horizontal base;

a left-hand stone pivotal member (7) positioned to the left-hand side of the fixed vertical object and having dimensions and orientation approximating the fixed object; wherein the left-hand stone pivotal member has a substantially rectangular shape and including an upper horizontal side, lower horizontal side and a pair of vertical sides, the sides defining a substantially rectangular shape horizontally oriented, wherein the horizontal sides are parallel with a ground surface and interconnecting the braces at a bottom portion thereof, wherein the left-hand stone pivotal member and the fixed vertical object define a first narrow space for placement of a first stone sheet therein, and wherein the left-hand stone pivotal member includes a cut-out portion centrally located and sized to allow a crane hook for placement therein when a sheet is delivered to the apparatus;

a right-hand stone pivotal member (7) positioned to the right-hand side of the fixed vertical object and having dimensions and orientation approximating the fixed object, wherein the right-hand side of the fixed vertical object and having dimensions and orientation of the fixed object; wherein the right-hand stone pivotal member has a substantially rectangular shape and including an upper horizontal side, lower horizontal side and a pair of vertical sides, the sides defining a substantially rectangular shape horizontally oriented, wherein the horizontal sides are parallel with a ground surface and interconnecting the braces at a bottom portion thereof, and wherein the right-hand stone pivotal member and the fixed vertical object define a first narrow space for placement of a first stone sheet therein, and wherein the left-hand stone pivotal member includes a cut-out portion centrally located and sized to allow a crane hook for placement therein when a sheet is delivered to the apparatus;

wherein the right-hand stone pivotal member and the fixed vertical object define a second narrow space for placement of a second stone sheet;

wherein the first and second narrow spaces are approximately the size of the stone sheets;

wherein the cut-out of the fixed vertical object is aligned with the respective cut-outs of the pivotal members when the pivotal members are vertically oriented;

at least a pair of hinges (11, 11) hingedly connecting a respective pivotal member to the vertical side of the base (4), each said hinge installing on the pivotal member (7) and further supporting the sheet thereon, wherein the hinges provide substantially 90-degrees of rotation for the pivotal members (7, 7), and wherein the hinges are dimensioned and configured to allow the pivotal members to be substantially supported by the ground surface when the pivotal members are horizontally oriented;

top braces for placement on top of respective vertical objects;

wherein a winch member (14) is attached to the fixed vertical object (15) and either the left-hand pivotal member or the right-hand pivotal member and an elongate member (13) is attached to the other one of the of the left-hand pivotal member and the right-hand pivotal member, wherein winding of the winch allows the respective pivotal member to be moved between the horizontal and vertical positions; and wherein the stone pivotal members (7, 7) are pivotable from a substantially vertical position to a substantial horizontal position, thereby allowing the vertically oriented stone sheet to be pivoted to and consequently worked on while horizontally oriented and supported by the pivotal member.

2. The apparatus of claim 1, wherein the frame further comprises a fixed object, the winch member being connected to the fixed object.

3. The apparatus of claim 2, wherein the fixed object comprises a substantially vertical surface, the substantially vertical surface being fixed in a substantially vertical position.

4. The apparatus of claim 3, wherein said substantially vertical surface is recessed to allow attachment to the sheet of stone to set the sheet of stone into the stone handling frame.

5. The apparatus of claim 3, wherein the frame further comprises one or more supporting members connected to said substantially vertical surface enabling said substantially vertical surface to remain in the substantially vertical position.

6. The apparatus of claim 1, wherein said pivotal member is recessed to allow attachment to the sheet of stone to set the sheet of stone into the stone handling frame.

7. The apparatus of claim 2, wherein the frame further comprises an additional pivotal member.

8. The apparatus of claim 7, wherein the pivotal members are located on opposing sides of the fixed object.

9. The apparatus of claim 1, wherein said pivotal member has a first end and a second end and the pivotal member being pivotal about a rotational axis at the first end.

10. The apparatus of claim 1, wherein said pivotal member is pivotal about a rotational axis that is located proximate to a ground surface.

11. The apparatus of claim 1, wherein said pivotal member being pivotal about a rotational axis, the rotational axis being located between an edge of the pivoting member and a center of the pivoting member.

12. The apparatus of claim 1, wherein the frame is configured to receive a sheet of stone in a vertical position and pivot the sheet of stone toward a ground in a horizontal position such that a center of gravity of the sheet of stone is at the vertical position is further from the ground than when the sheet of stone is in the horizontal position.

13. The apparatus of claim 1, wherein the frame further comprises one or more retaining members connected to said pivoting member enabling said pivoting member to remain in the substantially vertical position until the one or more retaining members are removed.

14. The apparatus of claim 2, wherein the frame further includes at least one support connected to the fixed object to provide support to the fixed object while the pivoting member is being pivoted so that the fixed object does not tip over.

15. The apparatus of claim 14, wherein the fixed object comprises a first end and a second end, the first end being proximate to the ground, and wherein the at least one support is connected to the fixed object proximate to the second end.

16. A method for handling sheets of stone comprising:

providing an apparatus of claim 1;

placing one or more sheets of stone in a substantially vertical position onto a pivotal member, the pivotal member comprising a first end, a center portion and a second end, wherein the pivotal member is capable of pivoting from a substantially vertical position to a substantially horizontal position; and pivoting said pivotal member from the substantially vertical position to the substantially horizontal position using a lowering member, the lowering member being connected to said pivotal member and configured to lower the second end of the pivotal member, said pivoting said pivotal surface occurs about an axis that is aligned along said first end; and placing the one or more stone sheets in the substantially vertical position and pivoted to the substantially horizontal position.

17. The method of claim 16, wherein said lowering member comprising a winch, winch, the winch comprising a cable that connects a fixed object to the pivotal member and is configured perform said pivoting said pivotal member by lowering one side of the pivotal member from the substantially vertical position to the substantially horizontal position.

18. The method of claim 16, further comprising placing an additional sheet of stone into an additional pivotal member and pivoting said additional pivotal member, said additional pivotal member being separate from any other pivotal member.

* * * * *